US007526834B2

(12) United States Patent
Coleman

(10) Patent No.: US 7,526,834 B2
(45) Date of Patent: May 5, 2009

(54) VACUUM CLEANING HEAD

(75) Inventor: James Martin Coleman, Malmesbury (GB)

(73) Assignee: Dyson Technology Limited, Wiltshire (GB)

( * ) Notice: Subject to any disclaimer, the term of this patent is extended or adjusted under 35 U.S.C. 154(b) by 102 days.

(21) Appl. No.: 11/664,389

(22) PCT Filed: Sep. 28, 2005

(86) PCT No.: PCT/GB2005/003722

§ 371 (c)(1),
(2), (4) Date: Mar. 30, 2007

(87) PCT Pub. No.: WO2006/040509

PCT Pub. Date: Apr. 20, 2006

(65) Prior Publication Data

US 2007/0256273 A1 Nov. 8, 2007

(30) Foreign Application Priority Data

Oct. 15, 2004 (GB) ..... 0422907.6

(51) Int. Cl.
*A47L 9/04* (2006.01)

(52) U.S. Cl. ..... 15/387; 15/378; 15/391

(58) Field of Classification Search ..... 15/375, 15/378, 387, 391; *A47I 9/04*
See application file for complete search history.

(56) References Cited

U.S. PATENT DOCUMENTS

| | | | | |
|---|---|---|---|---|
| 5,416,948 | A * | 5/1995 | Worwag | 15/331 |
| 5,950,275 | A | 9/1999 | Wörwag | |
| 2002/0108210 | A1 | 8/2002 | Kaffenberger | |

FOREIGN PATENT DOCUMENTS

| | | |
|---|---|---|
| DE | 3308294 | 9/1984 |
| DE | 42 29 030 | 3/1994 |
| EP | 0 564 222 | 10/1993 |
| EP | 0963 731 | 12/1999 |
| GB | 2 393 383 | 3/2004 |
| JP | 11009523 | 1/1999 |
| WO | WO-2004/028330 | 4/2004 |

* cited by examiner

*Primary Examiner*—David A Redding
(74) *Attorney, Agent, or Firm*—Morrison & Foerster, LLP

(57) ABSTRACT

A vacuum cleaning head includes a housing having an agitator in the form of a brush bar rotatably arranged in a chamber having an air inlet and an air outlet and also includes an air turbine for driving the brush bar is provided. The air turbine has its own air inlet for admitting clean air to drive the turbine. A restricting member is arranged in the outlet of the chamber so as to restrict the cross-section of the outlet when the head is pressed against a surface to be cleaned and to restrict the flow of air from the brush bar chamber. The restricting member is designed to distribute incoming air between the main inlet and the turbine inlet in a satisfactory ratio. Thus, more air flows through the turbine, enabling it to drive the brush bar at high rotational speed.

16 Claims, 7 Drawing Sheets

VACUUM CLEANING HEAD

REFERENCE TO RELATED APPLICATIONS

This application is a national stage application under 35 USC 371 of International Application No. PCT/GB2005/003722, filed Sep. 28, 2005, which claims the priority of United Kingdom Application No. 0422907.6, filed Oct. 15, 2004, the contents of both of which prior applications are incorporated herein by reference.

FIELD OF THE INVENTION

This invention relates to a vacuum cleaning head which can be used with, or form part of, a vacuum cleaner.

BACKGROUND OF THE INVENTION

Vacuum cleaners are generally supplied with a range of tools for dealing with specific types of cleaning. The tools include a floor tool for general on-the-floor cleaning. It is well-known to provide a floor tool in which a brush bar is rotatably mounted within a suction opening on the underside of the tool, with the brush bar being driven by an air turbine. The brush bar serves to agitate the floor surface beneath the tool so as to release dirt, dust, hair, fluff and other debris from the floor surface where it can then be carried by the flow of air to the vacuum cleaner itself. The turbine can be driven solely by 'dirty' air which enters the tool via the suction opening, it can be driven solely by 'clean' air which enters the tool via a dedicated inlet which is separate from the main suction opening, or it can be driven by a combination of dirty and clean air.

In a turbine driven tool which has a dedicated clean air inlet to drive the turbine which is separate from the main, floor engaging inlet, there can be a difficulty in driving the turbine at a sufficient speed. When viewed in terms of the amount of resistance experienced by the airflow, the path through the main inlet offers a lower resistance than the path through the turbine inlet. Thus, the airflow will tend to take the lower resistance path through the main inlet.

SUMMARY OF THE INVENTION

Accordingly, the invention provides a vacuum cleaning head comprising a housing having an agitator rotatably arranged in a chamber, the chamber having an air inlet and an air outlet, the housing further comprising an air turbine for driving the agitator and an air inlet in the housing for admitting air to drive the turbine, wherein a restrictor is arranged in the outlet of the chamber so as to restrict the outlet when the head is pressed against a surface to be cleaned.

The provision of a restrictor that restricts the chamber outlet when the tool is pressed against a surface permits a greater flow of air through the inlet associated with the turbine when the tool is being used in a cleaning operation. Thus the turbine, and hence the agitator, is driven at a higher rotational speed than was achievable hitherto, for efficient cleaning.

Advantageously, the restrictor moves against the force of resilient means so that, when the head is removed from the surface, the restrictor moves back to its previous position and restricts the outlet to a lesser extent, if at all. Thus, less air flows through the turbine so that it runs at a reduced speed. This helps prolong the life of the turbine, the agitator and the device that transmits torque between the turbine and the agitator, for example a pulley.

Preferably, the restrictor is associated with, and may be an integral part of, a sole plate, which may be pivotably mounted in the housing.

A catch may also be provided to release the sole plate and thus render accessible the chamber so that blockages may be removed by the user.

The agitator, which may be a brush bar, may itself be removable for replacement or repair.

In each aspect of the invention, the vacuum cleaning head can be a tool which attaches to the end of a wand or hose of a cylinder (canister, barrel) or upright vacuum cleaner, or it can form part of a vacuum cleaner itself, such as the cleaning head of an upright vacuum cleaner.

BRIEF DESCRIPTION OF THE DRAWINGS

The invention will now be described, by way of example, with reference to the accompanying drawings, in which:—

Like reference numerals refer to like parts throughout the specification.

DETAILED DESCRIPTION OF THE INVENTION

Figure 1:
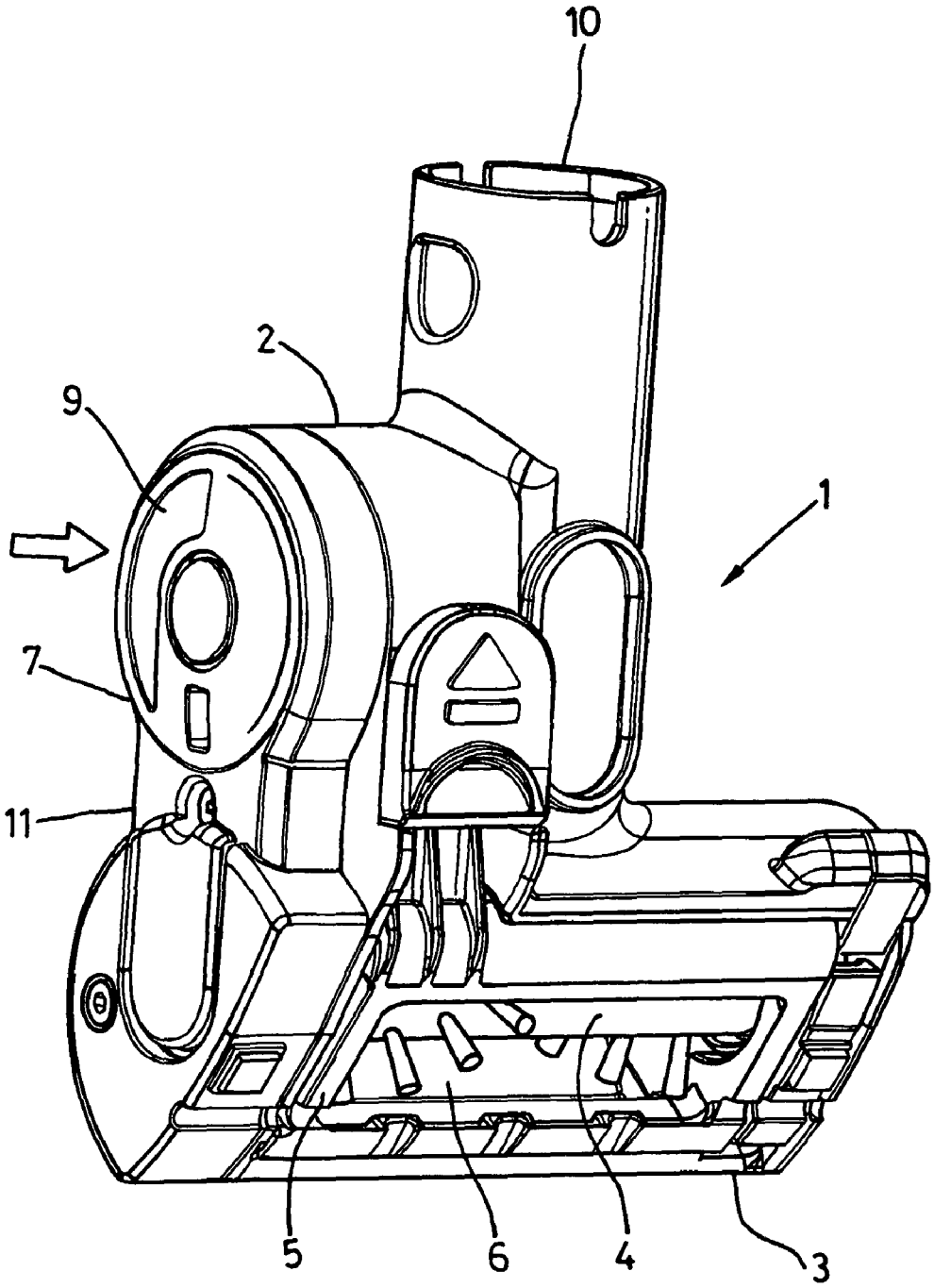
FIG. 1 is a perspective view from underneath of a cleaner head constructed according to the invention.

FIG. 1 illustrates a cleaner head constructed according to the invention in the form of a tool, which is indicated generally by the reference numeral 1. The tool 1 can be fitted to the end of a wand or hose of a vacuum cleaner. The tool comprises a main housing 2, which includes a chamber 3 arranged to receive an agitator. In this embodiment, the agitator is in the form of a brush bar 4, arranged to rotate along its longitudinal axis in the chamber 3. A sole plate 5 on the base of the tool 1 has a large aperture which defines an air inlet 6 for the chamber 3. In use, the air inlet 6 admits dirty air from the surface to be cleaned into the chamber 3.

The tool 1 further comprises an air turbine 7, which is arranged to drive the brush bar 4. The air turbine 7 includes an impeller (indicated schematically by the numeral 8 in FIG. 2), which is mounted about a drive shaft (not shown) within the chamber 3. A set of bearings (not shown) rotatably supports the drive shaft. An air inlet 9 to the turbine 7 is positioned at the side of the housing 2. Airflow through the turbine 7 is in a generally axial direction as indicated by the arrow in FIG. 1. In use, the turbine air inlet 9 admits clean air from the environment to drive the turbine 7. A porous cover, such as a mesh screen, may be fixed to the turbine air inlet 9 to prevent ingress of dust. The airflow from both clean and dirty air inlets is combined at the outlet 10 of the tool.

A driving mechanism connects the turbine 7 and the brush bar 4 and serves to transmit torque from the turbine to the brush bar. The driving mechanism typically comprises a pulley arrangement (not shown), which is driven by the output shaft of the turbine 7. A casing 11 surrounds the pulley system in order to protect it.

Figure 2:
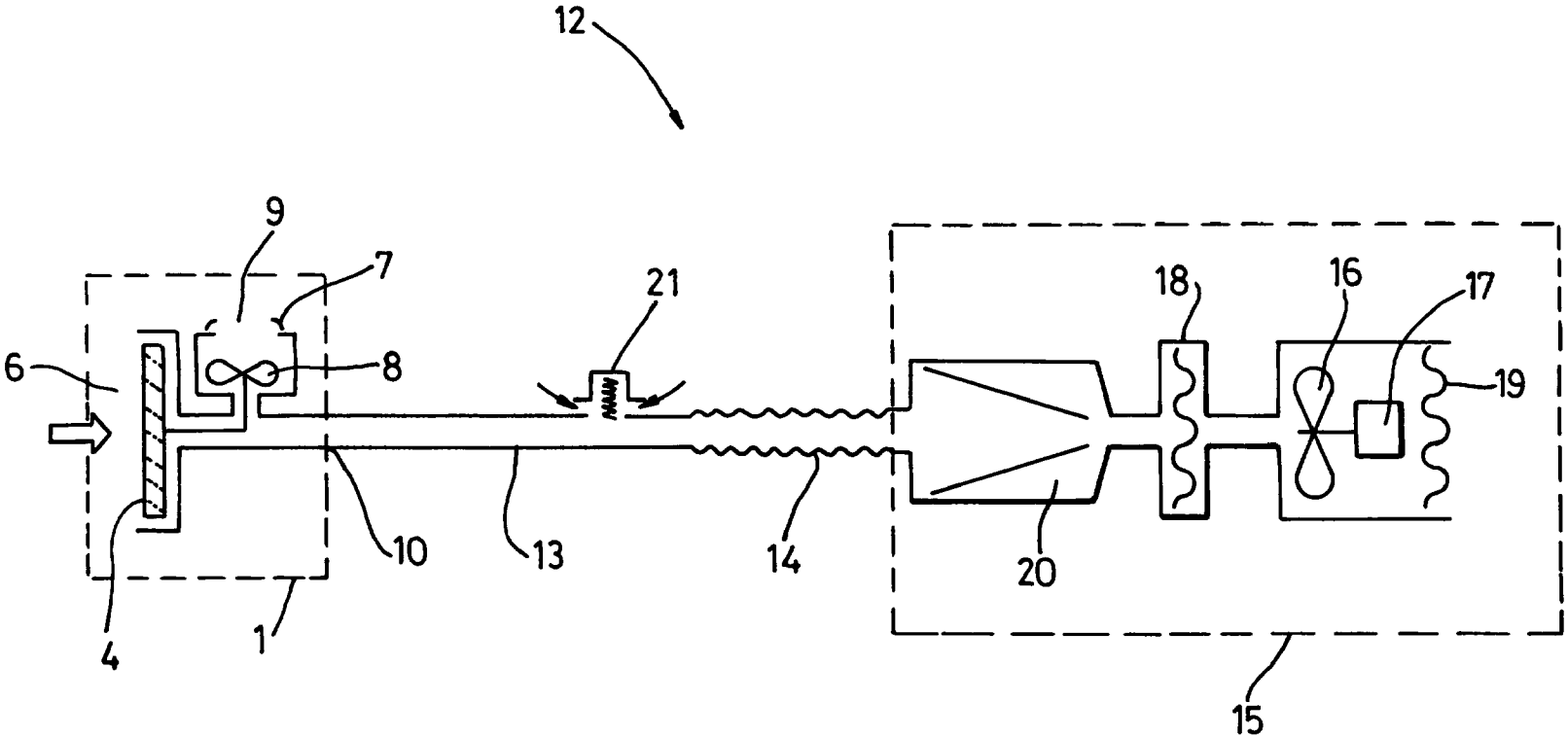
FIG. 2 is a schematic diagram of a vacuum cleaning system incorporating the cleaner head of FIG. 1.

FIG. 2 schematically shows the overall vacuum cleaning system 12 in which the tool can be used. The outlet 10 of the tool 1 is connectable to the distal end of a rigid wand or pipe 13 which a user can manipulate to direct the tool 1 where it is needed. A flexible hose 14 connects the wand 13 to the main body 15 of the vacuum cleaner. The main body 15 of the vacuum cleaner comprises a suction fan 16 which is driven by a motor 17. The suction fan 16 serves to draw air into the main body 15 of the vacuum cleaner via the tool 1, wand 13 and hose 14. Filters 18 and 19 are positioned each side of the fan 16. Pre-motor filter 18 serves to prevent any fine dust from reaching the fan 16 and post-motor filter 19 serves to prevent any fine dust or carbon emissions from the motor 17 from being expelled from the cleaner 12. A separator 20, such as a cyclonic separator or filter bag serves to separate and dirt, dust and debris from the dirty airflow which is drawn into the main body 15 by the suction fan 16. All separated matter is collected by the separator 20.

In use, the suction force created by suction fan 16 draws air into the tool 1 via the main suction inlet 6 on the underside of the tool and through the turbine air inlet 9. Air flowing through inlet 9 is used to drive the turbine 7 before flowing towards the main body 15 of the vacuum cleaner 12. Dirty air which is drawn through the main suction inlet 6 does not pass through the turbine 7 at all. In this way, the turbine 7 does not become fouled with dirt and debris from the dirty airflow.

A suction release trigger 21 is provided on a handle of the wand 13. The suction release trigger 21 is a valve that can be operated by a user to admit air into the wand 13 and to reduce the level of suction at the tool 1. Normally, a user will operate this valve when the suction airflow draws an item, such as a lightweight rug, against the inlet 6, so that the item becomes stuck to the tool 1. Air is admitted into the airflow path via the suction release trigger 21, suction at the inlet 6 is reduced and the object which has been 'stuck' to the tool is released.

Figure 3A:
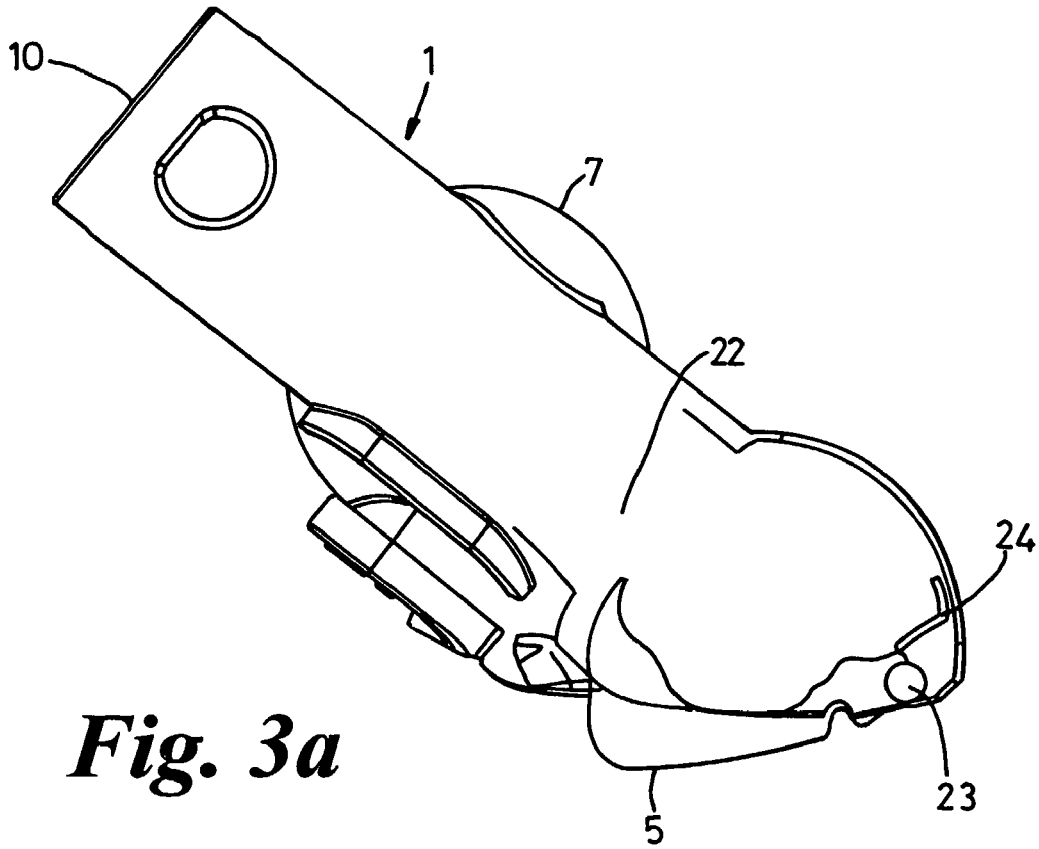
FIG. 3*a* is a partly-sectional side view of the cleaner head of FIG. 1 in a first position.

FIG. 3*a* is a partly sectional side view of the tool 1. The sole plate 5 is pivotably mounted in the chamber 3 and, in this position, extends below the lower surface of the housing 2 of the tool 1. In this drawing, the outlet 22 of the chamber is also visible. The outlet 22 of the chamber 3 communicates with the outlet 10 of the tool 1. The pivot 23 for the sole plate 5 is provided at the front of the tool, close to the front wall of the housing 2. The inner surface of the front wall is provided with resilient means in the form of a metal tab 24, which abuts the front upper surface of the sole plate 5, adjacent the pivot 23. Another pivot and metal tab may be provided on the other side of the tool 1. The tool 1 also includes a restrictor in the form of restricting member 25 arranged adjacent the outlet 22 of the chamber. In this embodiment, the restricting member 25 is an integral part of the pivotable sole plate 5.

Figure 3B:
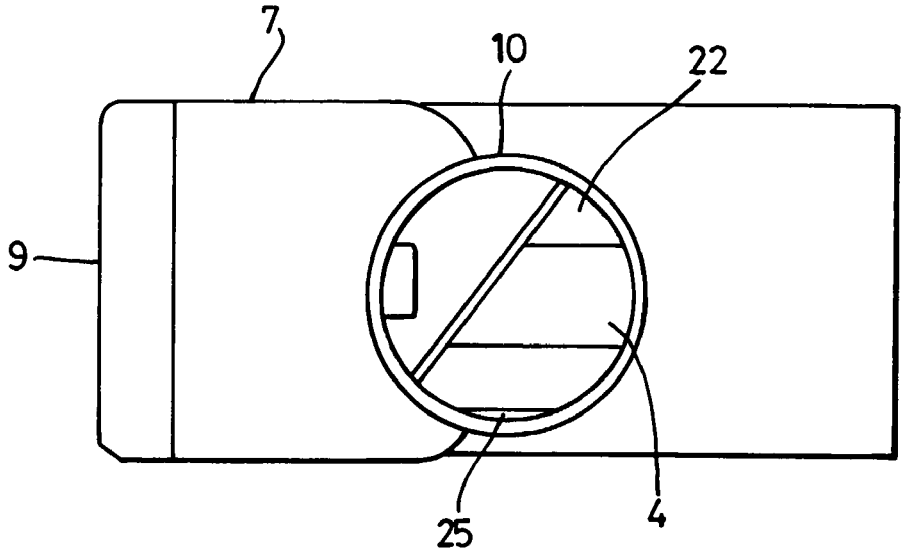
FIG. 3*b* is a view from behind of the cleaner head of FIG. 1 in the first position.

The tool 1 is shown from behind in FIG. 3*b*, looking down the outlet 10. In this position, the restricting member 25 only slightly extends into the outlet 22 of the chamber 3.

One of the problems with a turbine-driven tool which has a dedicated inlet for air to drive the turbine is that too great a proportion of the incoming air can flow into the tool via the main suction inlet 6 rather than through the turbine 7. When viewed in terms of the amount of resistance experienced by the airflow, the path through the main inlet 6 offers a lower resistance than the path through the turbine inlet 9.

In accordance with the invention, the tool 1 is arranged so that, when it is pressed against a surface to be cleaned, the sole plate 5 pivots towards the housing 2 and the restricting member 25 extends further into the outlet 22 of the chamber 3, thereby restricting the outlet by reducing its effective cross-sectional area. The restricting member 25 serves to restrict the flow of air from the brush bar chamber 3. The restricting member 25 is designed to distribute incoming air between the main inlet 6 and the turbine inlet 9 in a satisfactory ratio. Thus, a higher proportion of the suction airflow through the tool travels via the turbine 7, causing the impeller 8 to spin faster. Consequently, the brush bar is driven at a higher rotational speed, sufficient for effective cleaning.

Figure 4A:
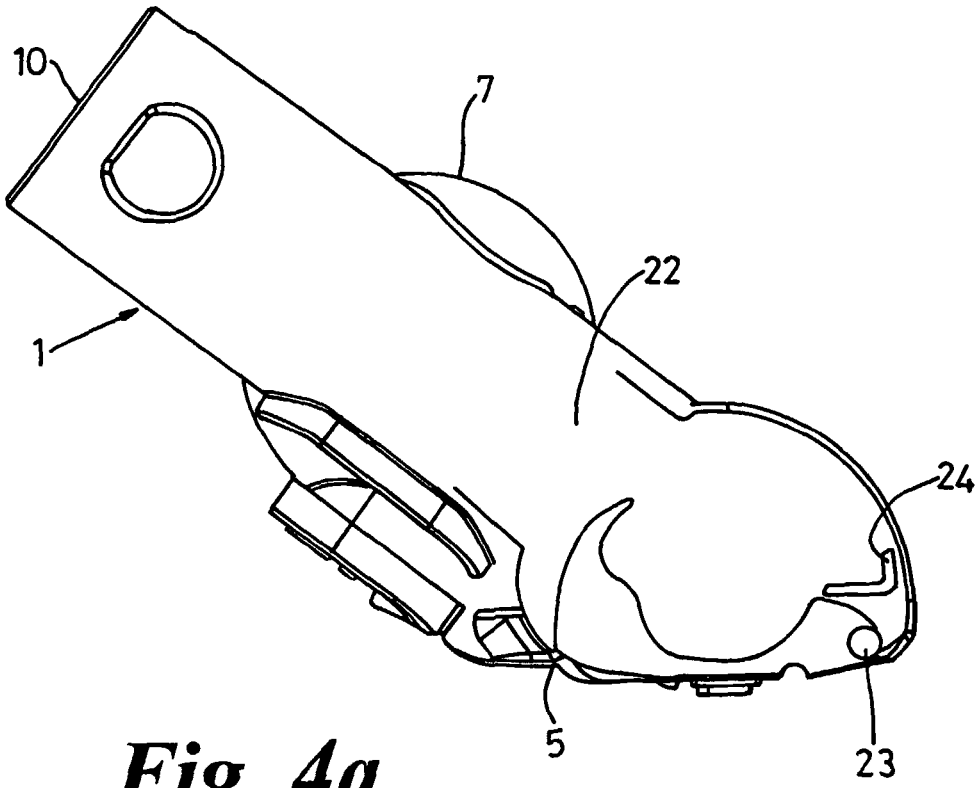
FIG. 4*a* is a partly-sectional side view of the cleaner head of FIG. 1 in a second position.
Figure 4B:
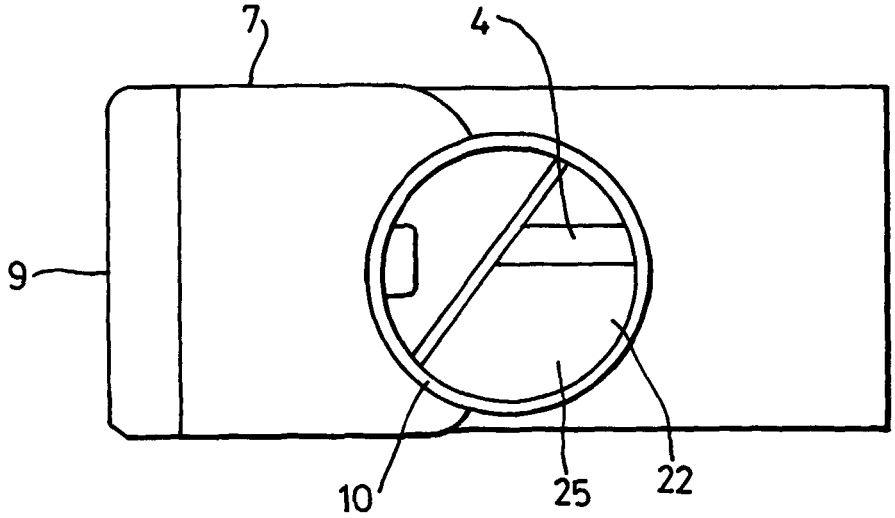
FIG. 4*b* is a view from behind of the cleaner head of FIG. 1 in the second position.
Figure 5:
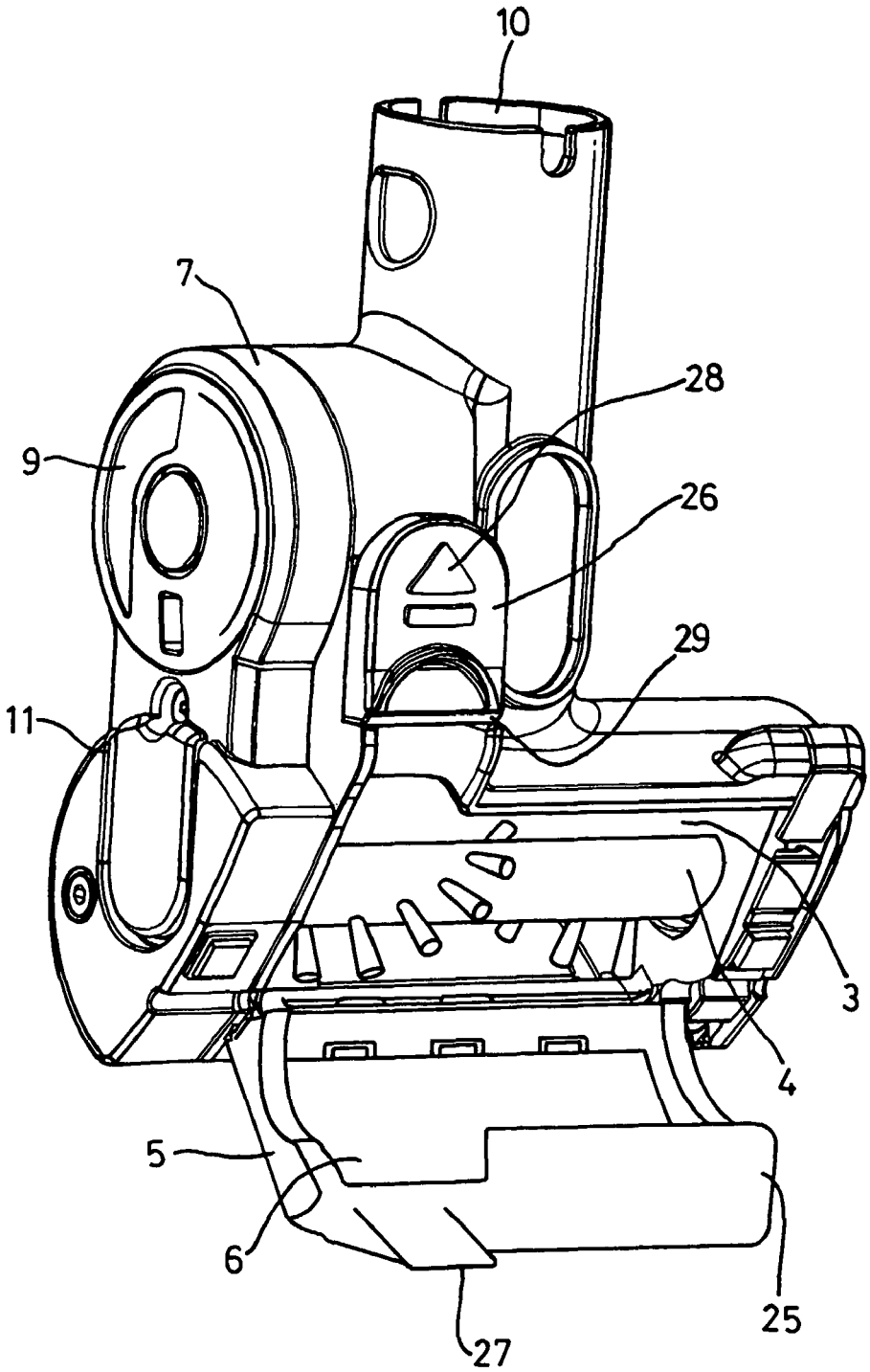
FIG. 5 is a perspective view from underneath of the cleaner head of FIG. 1 with the soleplate released.

The tool 1 is shown in FIGS. 4*a* and 4*b* with the restricting member 25 extending into the chamber outlet 22. In use, the user simply presses the tool 1 against the surface to be cleaned. This causes the sole plate 5 to pivot upwardly into the housing 2 of the tool, so that the bristles on the brush bar 4 extend slightly through the aperture that comprises the inlet 6. As the brush bar 4 rotates, the bristles on the brush bar flick dirt and dust out of the fibers of the carpet being cleaned. The restricting member 25, being constrained to move with the sole plate 5, therefore moves upwardly and restricts the cross-section of the outlet 22 of the chamber. FIG. 4*b* shows that the invention effects a substantial change in the cross-sectional area of the outlet 22. The chamber outlet 22 offers a higher resistance to the suction airflow than does the turbine inlet 9. Thus, a higher proportion of the suction airflow is drawn through the turbine 7 than was achievable with conventional turbine-driven tools.

When the sole plate 5 pivots upwardly into the housing 2, the front upper edge of the sole plate is urged against the or each resilient metal tab 24, thereby deforming it. When the user has finished cleaning a surface with the tool 1, the user lifts the tool from the surface and the resilient metal tabs 24 urge the sole plate 5 back into the position shown in FIGS. 3*a* and 3*b*. The restricting member 25 also returns to its former position wherein it only slightly extends into the outlet 22 of the chamber 3. Thus, more air flows through the dirty air inlet 6 than through the turbine inlet 9. The speed at which the brush bar 4 is driven is reduced. This saves wear and tear on the turbine and on the pulley system when the brush bar 4 is not being used in a cleaning operation.

The tool 1 also includes a catch 26 arranged to engage a protruding portion 27 extending from the sole plate 5 remote from the pivot 23 in the housing 2. The catch 26 is slidably releasable in order to release the protruding portion 27 of the sole plate 5. Thus, the sole plate 5 may be pivotably moved outwardly, away from the chamber 3, in order to make the chamber accessible. This may be to allow the user to clear blockages in the chamber, to remove fibers entangled in the bristles of the brush bar 4, or to allow the user to replace the brush bar 4. The brush bar 4 may be pivotably releasable through the suction opening, such as is described in our co-pending patent application GB0410699.3. Visual indicia, in the form of an arrow 28 for example, may be provided on the catch 26, in order to assist the user in releasing the catch correctly. When the user wishes to replace the sole plate 5, the user simply pivots the sole plate back towards the housing 2. The protruding portion 27 of the sole plate 5 is urged against a bevelled edge 29 on the catch 26, thereby causing the catch to slide away from the protruding portion of the sole plate. Resilient means (not shown) in the catch 26 serve to return the catch to its normal position once it has re-engaged the sole plate 5.

The invention provides a turbine-driven tool in which the agitator is driven at increased speed when the tool is employed and yet is able to power-down when not being actively used. Thus, the agitator is able to increase the effectiveness of a cleaning operation. Wear and tear to the component parts is reduced by causing them to rotate at reduced speed when not in active use.

Figure 6:
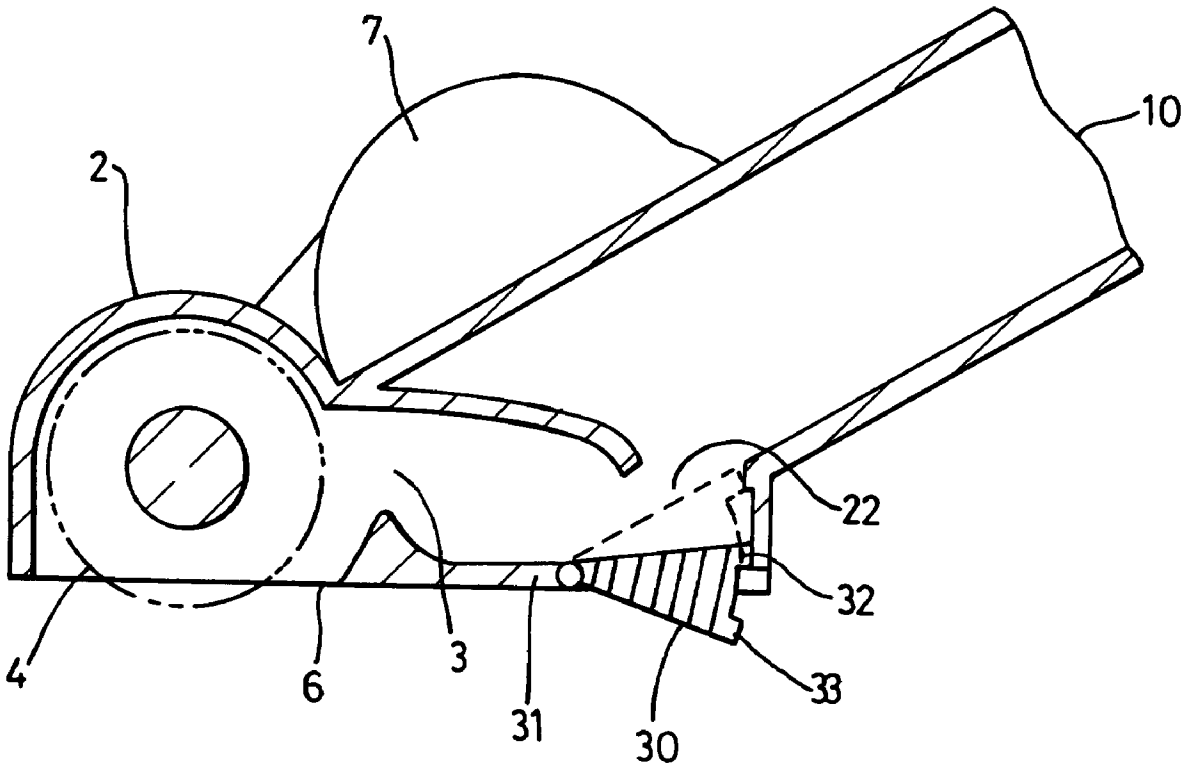
FIG. 6 is a partly-sectional side view of a cleaner head constructed according to an alternative embodiment of the invention.

An alternative tool is shown in FIG. 6. As in the FIG. 1 embodiment, this tool comprises a main housing 2, a chamber 3 arranged to receive a brush bar 4 and having an outlet 22, a dirty air inlet 6, a turbine 7 (the inlet of which is not visible in this drawing) and a tool outlet 10.

In this embodiment, the restrictor is in the form of a wedge 30, the thin end portion of which is pivotably mounted in the lower surface 31 of the floor tool. The wedge 30 occupies a rear portion of the tool and, in the position shown in solid lines in FIG. 6, extends below the lower surface 31 of the tool. In use, when the tool is pressed against a surface to be cleaned, the wedge 30 is pivotably urged upwardly into the tool and occupies the position shown in broken lines in this drawing. Thus, the cross-section of the outlet 22 of the chamber 3 is restricted, causing a higher proportion of suction airflow to flow through the turbine 7 than through the air inlet 6. The broad end portion of the wedge 30 has stops 32, 33 at both ends, to define the limits of movement of the wedge. The wedge 30 may be arranged to extend across most of the width of the tool, or to occupy a portion of it. When the tool is lifted from the floor surface, the wedge returns to the position shown by unbroken lines in the drawing, so that more air is drawn through the inlet 6 than through the turbine 7. The wedge may return to its original position by the influence of gravity, or may be assisted by, for example, a spring.

Figure 7:
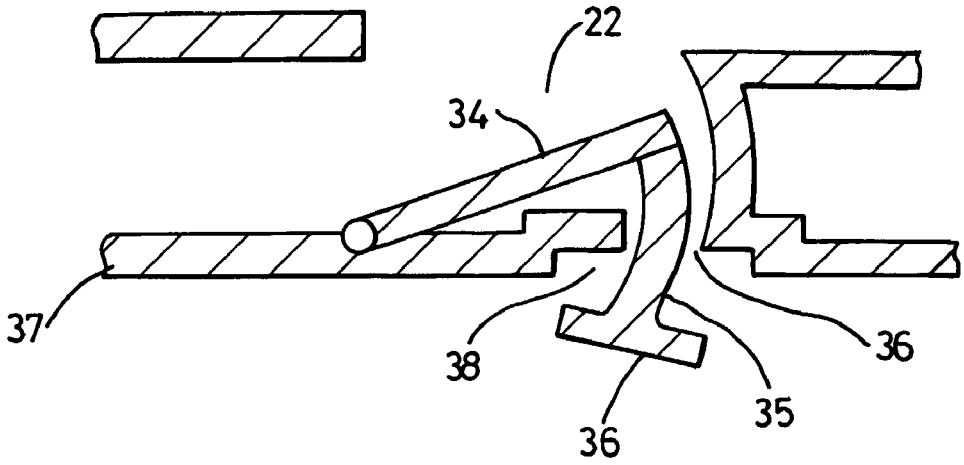
FIG. 7 is a sectional side view of part of a cleaner head constructed according to another alternative embodiment of the invention.

Another alternative restricting member is illustrated in FIG. 7. In this embodiment, the restriction comprises a plate 34, pivotably mounted at one end portion inside the tool. The other end portion of the plate 34 has an arcuate arm 35, which extends through a slot 36 in the lower surface 37 of the tool. The arm 35 ends in a stop 36, which extends in a direction transverse to the arm. In use, when the tool is pressed against a surface to be cleaned, the arm 35 pivots upwardly into the tool, causing the plate 34 to be elevated into a position where it reduces the cross-sectional area of the outlet 22. The stop 36 is pressed into a recess 38 in the lower surface 37 of the tool and prevents the arm 35 from being pushed too far into the tool.

Figure 8:
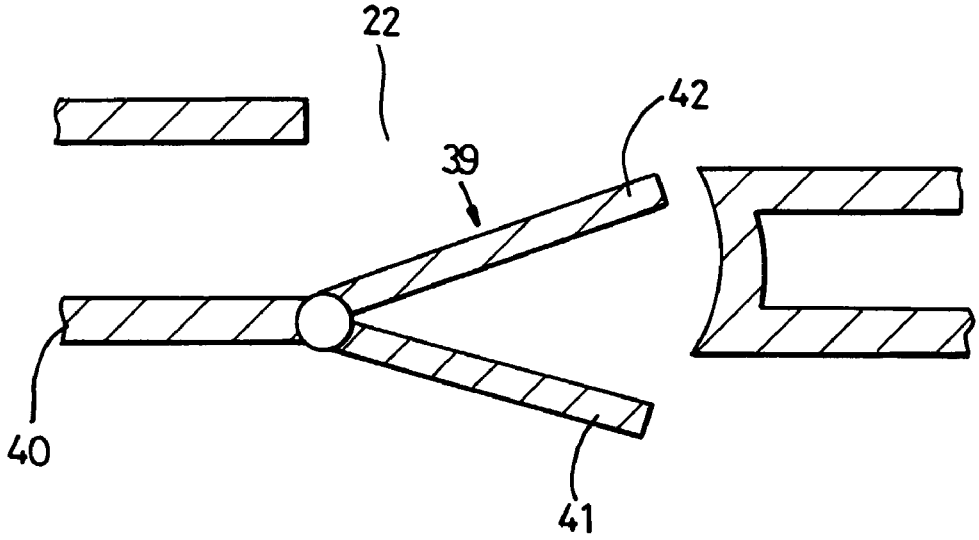
FIG. 8 is a sectional side view of part of a cleaner head constructed according to a further alternative embodiment of the invention.

A further alternative embodiment is shown in FIG. 8, in which the restrictor comprises a V-shaped member 39, pivotably mounted at its apex in the lower surface 40 of the tool. One arm 41 of the V-shaped member is arranged to extend below the lower surface 40 of the tool. Thus, when the tool is pressed against a surface to be cleaned, the arm 41 is pushed against the lower surface 40 of the tool. Consequently, the other arm 42 of the V-shaped member 39 pivots upwardly, so as to restrict the effective cross-sectional area of the outlet 22. Raising the tool from the surface causes the restrictor to assume its original position.

Further variations will be apparent to the person skilled in the art. For example, with reference to the first embodiment of the invention, although it is convenient to form the restricting member and the sole plate as one piece, they may be formed separately. The restricting member and the sole plate may be urged against respective resilient means.

The restricting member need not extend across the full width of the outlet to the chamber. Alternatively, or additionally, the restricting member may be profiled so as to present an optimum restriction in the cross-section of the outlet, or differing restrictions to the outlet in dependence on the extent to which the tool is pushed against a surface to be cleaned.

The resilient means need not comprise deformable metal tabs. Helical springs, foam wedges or other suitable resilient mechanisms may be employed.

The invention has been described with reference to a tool having a brush bar but is equally suitable in connection with other forms of agitator, such as a beater. The agitator need not be driven by a pulley system; a system of gears, for example, may be employed to transmit torque from the turbine to the agitator.

The invention claimed is:

1. A vacuum cleaning head comprising:

a housing comprising a chamber having an air inlet and an air outlet;

an agitator arranged in the chamber;

a turbine for driving the agitator;

a turbine air inlet for admitting air to drive the turbine; and a restrictor arranged in the air outlet of the chamber and configured to move when the head is pressed against a surface to be cleaned so as to restrict airflow through the air outlet of the chamber.

2. The vacuum cleaning head of claim 1, wherein the restrictor is configured to move in accordance with a force of a resilient member when the head is no longer pressed against the surface so as to decrease restriction of airflow through the air outlet of the chamber.

3. The vacuum cleaning head of claim 1 or 2, wherein the restrictor is pivotably attached to the housing.

4. The vacuum cleaning head of claim 1 or 2, wherein the restrictor is associated with a sole plate.

5. The vacuum cleaning head of claim 1 or 2, wherein the restrictor is integral with a sole plate.

6. The vacuum cleaning head of claim 4, wherein the sole plate has an aperture and is moveable between a first position, in which it extends below a lower surface of the housing, and a second position, in which part of the agitator extends through the aperture.

7. The vacuum cleaning head of claim 4, further comprising a catch configured to releasably engage the sole plate.

8. The vacuum cleaning head of claim 7, wherein the sole plate is pivotable so as to allow access to the chamber.

9. The vacuum cleaning head of claim 1 or 2, wherein the agitator is removable.

10. The vacuum cleaning head of claim 1 or 2, wherein the agitator comprises a brush bar, rotatably mounted in the chamber.

11. The vacuum cleaning head of claim 1 or 2, further comprising a pulley system for transmitting torque generated by the turbine to the agitator.

12. A vacuum cleaner incorporating the vacuum cleaning head of claim 1 or 2.

13. A method of vacuum cleaning a surface comprising a step of pressing the vacuum cleaning head of claim 1 or 2 against a surface to be cleaned such that the restrictor restricts airflow through the outlet to the chamber.

14. The vacuum cleaning head of claim 3, wherein the restrictor is associated with a sole plate.

15. The vacuum cleaning head of claim 5, wherein the sole plate has an aperture and is moveable between a first position, in which it extends below the lower surface of the housing, and a second position, in which part of the agitator extends through the aperture.

16. The vacuum cleaning head of claim 6, further comprising a catch configured to releasably engage the sole plate.

* * * * *